United States Patent [19]

Keith

[11] 4,056,195

[45] Nov. 1, 1977

[54] SUPPORTING BASE FOR RACK

[75] Inventor: William Johnson Keith, Greenville, S.C.

[73] Assignee: Metal Products Corporation, Greenville, S.C.

[21] Appl. No.: 675,818

[22] Filed: Apr. 12, 1976

Related U.S. Application Data

[63] Continuation of Ser. No. 482,858, June 25, 1974, abandoned.

[51] Int. Cl.[2] ..... A47F 5/01

[52] U.S. Cl. ..... 211/153; 52/627; 52/670; 108/51.1; 108/55.1

[58] Field of Search ..... 108/51.1–57.1; 211/153; 34/238; 52/475, 626, 627, 629, 619, 656, 670; 220/19; 248/346

[56] References Cited

U.S. PATENT DOCUMENTS

| | | | |
|---|---|---|---|
| 829,966 | 9/1906 | Jefferis | 52/627 |
| 1,914,646 | 6/1933 | Rand | 52/629 |
| 2,094,381 | 9/1937 | Slayter | 52/627 X |
| 2,276,981 | 3/1942 | John | 52/627 X |
| 2,466,226 | 4/1949 | Gilbertie | 108/55.1 X |
| 2,675,895 | 4/1954 | Lowenstein | 52/656 X |
| 2,818,937 | 1/1958 | Brixius | 52/656 |
| 2,827,670 | 3/1958 | Schwindt | 52/627 X |
| 3,131,655 | 5/1964 | Sellers et al. | 108/51.1 |
| 3,193,093 | 7/1965 | Hansen | 108/53.5 X |
| 3,762,344 | 10/1973 | Chez | 108/51.1 |

*Primary Examiner*—Roy D. Frazier
*Assistant Examiner*—William E. Lyddane
*Attorney, Agent, or Firm*—Bailey, Dority & Flint

[57] ABSTRACT

A supporting base for a rack formed of four "c" channel members joined end to end defining a rectangular frame. The "*c*" channel members have an open side facing the center thereof into which the free edges of an expanded metal member corresponding in size to the frame extends and is secured to the bottom side of an upper flange thereof as by welding. Cross braces are carried below the expanded member and terminate within the "*c*" channel members with the expanded metal member being supported on an upper surface thereof. In one particular embodiment, the expanded metal member slopes towards an axis extending between opposed sides so that when articles are positioned thereon, such will also slope towards said axis.

1 Claim, 6 Drawing Figures

Fig. 1.
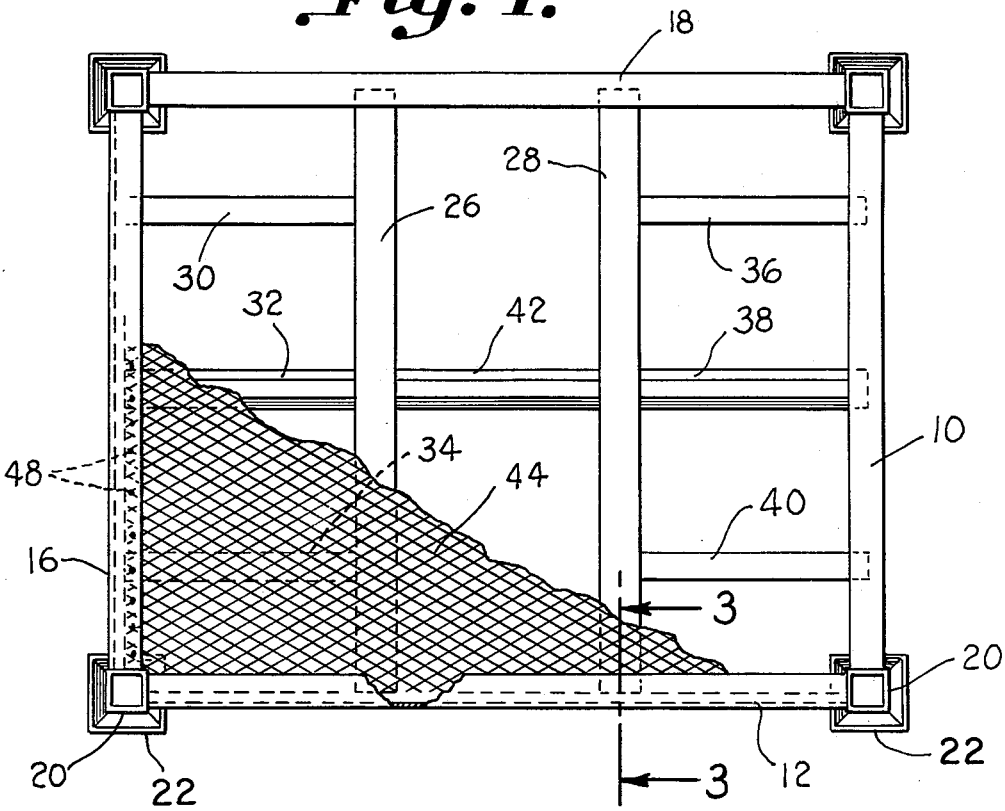
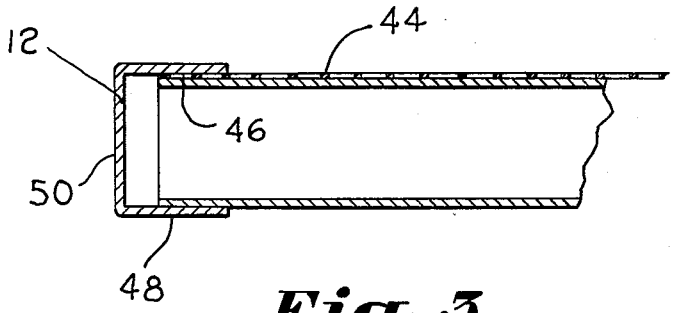
Fig. 3.
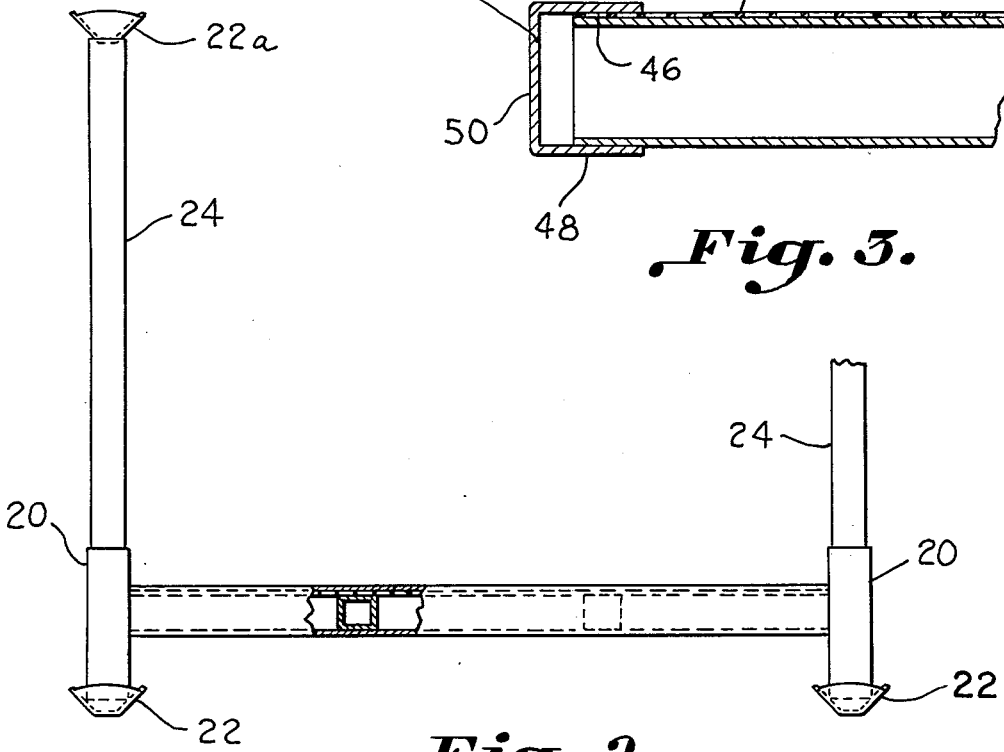
Fig. 2.

SUPPORTING BASE FOR RACK

This is a continuation of application Ser. No. 482,858, filed June 25, 1974, now abandoned.

BACKGROUND OF THE INVENTION

This invention relates to a supporting base for a rack and more particularly to a base member which has a smooth planar supporting surface with no jagged or free edges.

Supporting racks heretofore utilized have been generally constructed of tubular members which are welded together in end to end fashion to define a square or rectangular frame. Normally, corner posts extend upwardly from the base member and are provided with targets so that the racks can be stacked one on top of the other. Sometimes expanded metal is used as a supporting surface for the rack and this expanded metal is cut to a size corresponding to the size of the frame and secured to the tubular members as by welding. When such is secured to the top of the frame, it presented jagged edges that are a hazard to personnel as well as to the articles carried on the rack. Attempts to overcome this problem have incorporated the idea of folding the expanded wire over and back under the tubular members. While such eliminated the free edges on top of the rack, the free edges are still exposed on the bottom side thereof. Furthermore, such requires additional metal so as to be folded around the tubular members. Another problem in using tubular members is that when braces were utilized therewith, large welds are required at the joints of the tubular members or where a brace abuts against the frame so as to achieve the desired strength thereof.

SUMMARY OF THE INVENTION

The subject invention contemplates constructing a rack of four "*c*" channel members joined end to end so as to define a square or rectangular frame. The open side of the channel members extend toward the center of the frame. Expanding metal wire is tucked within the "*c*" channel and secured to the underside of the top flange of the channel members as by spot welding. In order to provide additional support for the expanded metal wire, cross braces extend between opposed sides of the frame and terminate within the "*c*" channel members. The expanded wire is sandwiched between the underside of the top flange of the "*c*" channel members and an upper surface of the cross braces. As a result, less welding is required and there are no exposed, ragged edges.

Accordingly, it is the general object of the present invention to provide a rack assembly wherein there is a minimum of free edges.

Still another important object of the present invention is to provide a rack assembly constructed of "*c*" channel members wherein a supporting surface is tucked within the "*c*" channel memers producing a substantially planar upper surface.

Another important object of the present invention is to provide a rack assembly wherein an upper surface thereof tapers towards an axis extending between two opposed sides so that when articles are placed thereon, such also tend to tilt towards the center of the rack so as to minimize the chances of falling off.

These and other objects and advantages of the invention will become apparent upon reference to the following specification, attendant claims and drawings.

BRIEF DESCRIPTION OF THE DRAWINGS

FIG. 1 is a plan view illustrating a rack constructed in accordance with the present invention, FIG. 2 is a side, elevational view of the rack partially in section shown in FIG. 1, FIG. 3 is a sectional view taken along line 3—3 of FIG. 1.

DESCRIPTION OF THE PREFERRED EMBODIMENT

Figure 4:
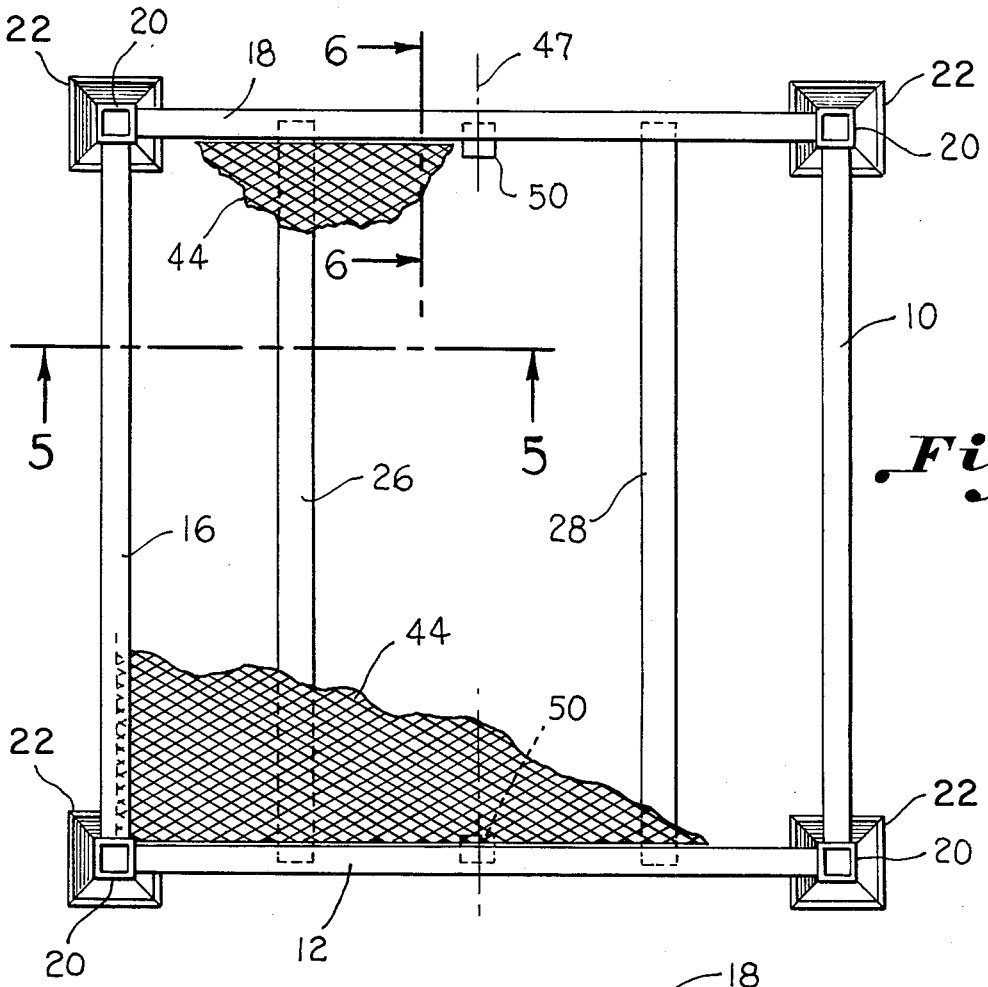
FIG. 4 is a plan view of a modified form of the invention wherein a supporting surface of the rack slopes towards the center thereof.

Referring in more detail to FIG. 1, there is illustrated four "*c*" channel members 10, 12, 16 and 18 which are joined end to end so as to define a substantially square frame. The "*c*" channel members may be constructed of any suitable material such as steel, the gauge depending on the desired strength of the rack. The ends of the "*c*" channel members 10 through 18 are welded to square tubular cornerposts 20. Carried on the bottom of the cornerposts 20 are nesting targets 22 which are substantially cup-shaped having a flat bottom portion. The cornerposts 20 extend slightly above the frame of the rack and are provided for receiving square tubular extentions 24 which also have stacking targets 22a welded on the top thereof. As can be seen in FIG. 2, the targets 22a face upwardly so that another rack can be stacked on top thereof.

In order to add rigidity to the rack, suitable cross bracing extends between the side walls of the frame. Tubular cross braces 26 and 28, extend between the "*c*" channel members 12 and 18 with the ends thereof extending within the channel members. The cross braces 26 and 28 are attached to the channel members 12 and 18 as by welds. Transverse cross braces such as 30, 32, 34, 36, 38 and 40 extend between the braces 26 and 28 and the side channel memers 10 and 16. A central transverse cross brace 42 is welded between the braces 26 and 28.

A rectangular shaped expanded metal member 44 which corresponds in size to the frame is provided for producing a planar supporting surface for the rack. The expanded metal member 42 has free edges which are tucked within the "*c*" channel members 10, 12, 16 and 18 so as not to have an exposed free edge. The expanded metal member 44 is attached to the underside of a top flange 46 of the channel members by welding. Since the welds 48 are on the underside of the top flange 46, such does not interfere or present a jagged, external protrusion.

Furthermore, since the expanded metal member 44 is sandwiched between an upper surface of the braces and the underside of the flange 46 of the "*c*" channel members, less welding is required to secure the expanded metal member 44 to the frame.

It is noted that the lower surfaces of braces 26 and 28 are supported on a lower flange of the "C" channel members.

In order to define the "*c*" channel shaped members positively, each includes an upper flange 46 and a lower flange 48 which are joined by a vertical flange 50 such as shown in FIG. 3.

Figure 6:
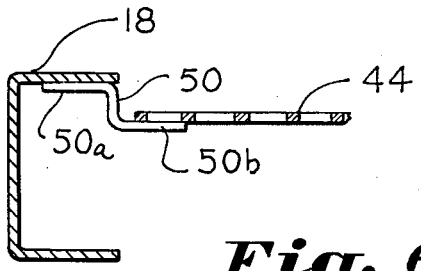
FIG. 6 is a sectional view taken along line 6—6 of FIG. 4.
Figure 5:
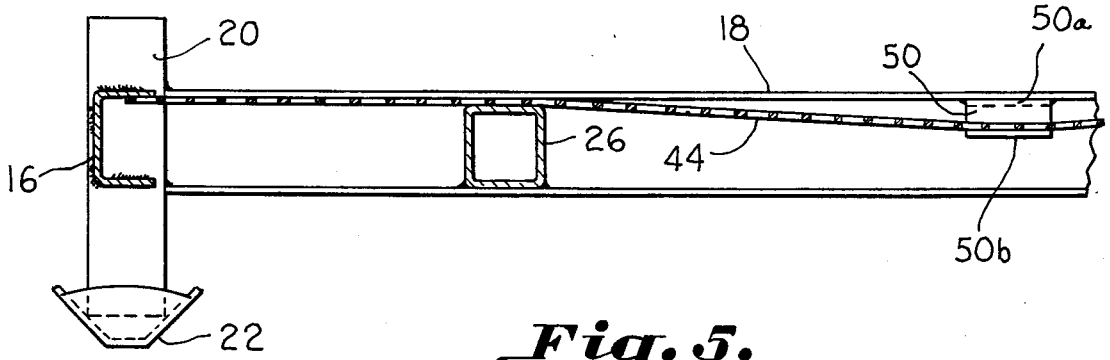
FIG. 5 is a sectional view taken along the line 5—5 of FIG. 4.

FIGS. 4, 5 and 6 illustrate a modified form of the invention and like reference characters will be utilized for the same and corresponding parts as that shown in the device in FIGS. 1 through 3. As can be seen in FIGS. 4 and 5 between the braces 26 and 28, the expanded metal member 44 tapers downwardly towards an axis 47 extending between the side "*c*" channel members 10 and 16. Welded on this axis to the underside of the channel members 12 and 18 is an S-shaped clamp 50. One flange of the S-shaped clamp 50 is welded to the underside of the upper flange of the "*c*" channel member 18. A downwardly and vertically spaced flange **50*b* of the clamp 50 extends towards the center of the frame for supporting an edge of the expanded metal member 44 along the axis 47. The expanded metal member may be attached to the clamp 50 by any suitable means such as welding. As is seen in FIG. 5, the expanded metal member 44** slopes downwardly adjacent the center. Such is to cause the articles carried on the rack to tilt towards the center minimizing the chances of such falling thereoff.

While a preferred embodiment of the invention has been described using specific terms, such description is for illustrative purposes only, and it is to be understood that changes and variations may be made without departing from the spirit or scope of the following claims.

What is claimed is:

1. A supporting base for a rack comprising:

a. four "*c*" channel members joined end to end defining a rectangular frame;

b. said "*c*" channel members having an opened side facing the center of said frame and include a top and bottom flange joined by a vertical flange, c. a rectangular shaped expanded metal member corresponding in size to said frame for spanning said rectangular frame;

d. free edges of said expanded metal member extending in two of said "*c*" channel members and being secured thereto so as not to have an exposed edge, said two channel members being in opposing relationship, e. cross braces carried below said expanded metal member with ends thereof engaging said channel members;

f. an abutment member carried by each of said "*c*" channel members other than said two opposing "*c*" channel members, said abutment members extending below said top flanges of said other two "*c*" channel members; and g. said expanded metal member sloping downwardly to said abutment members and being supported thereon providing an inclined base surface for stacking articles:

whereby stacked articles on said supporting base slope inwards reducing the tendency of said articles to fall from said rack.

* * * * *